United States Patent [19]

Riggs, Jr. et al.

[11] 4,243,494

[45] Jan. 6, 1981

[54] PROCESS FOR OXIDIZING A METAL OF VARIABLE VALENCE BY CONTROLLED POTENTIAL ELECTROLYSIS

[75] Inventors: Olen L. Riggs, Jr., Bethany; Dennis A. Brunsell, Oklahoma City, both of Okla.

[73] Assignee: Kerr-McGee Corporation, Oklahoma City, Okla.

[21] Appl. No.: 31,319

[22] Filed: Apr. 19, 1979

[51] Int. Cl.[3] ..... C25C 1/22

[52] U.S. Cl. ..... 204/1.5; 204/1 R; 204/96; 204/105 R

[58] Field of Search ..... 204/1 R, 1.5, 96, 105 R

[56] References Cited

U.S. PATENT DOCUMENTS

| | | | |
|---|---|---|---|
| 2,288,752 | 1/1941 | Simpson | 204/90 |
| 3,361,651 | 1/1968 | Parkinson et al. | 204/1.5 |
| 3,479,139 | 11/1969 | Koerner, Jr. | 423/321 |
| 3,616,276 | 10/1971 | Schneider et al. | 204/1.5 |
| 3,689,378 | 9/1972 | Neff et al. | 204/1.5 |
| 3,770,612 | 11/1973 | Gray et al. | 204/1.5 X |
| 3,836,476 | 9/1974 | Baldwin et al. | 252/301.1 R |

*Primary Examiner*—Leland A. Sebastian
*Attorney, Agent, or Firm*—William G. Addison

[57] ABSTRACT

A process for oxidizing a metal of variable valence to a higher valence state by electrochemical means. More particularly, a process for oxidizing a metal of variable valence, such as, for example, uranium or vanadium contained in wet process phosphoric acid to a higher valence state for extraction by subsequent contact with complex organic extractants. The wet process phosphoric acid is oxidized in an electrolytic cell operated at a controlled potential via use of a reference electrode. The cell comprises a tank having at least one anode and at least one cathode, said anode and cathode having a ratio of surface areas exposed to the electrolyte in said cell of from at least about 100:1.

8 Claims, 1 Drawing Figure

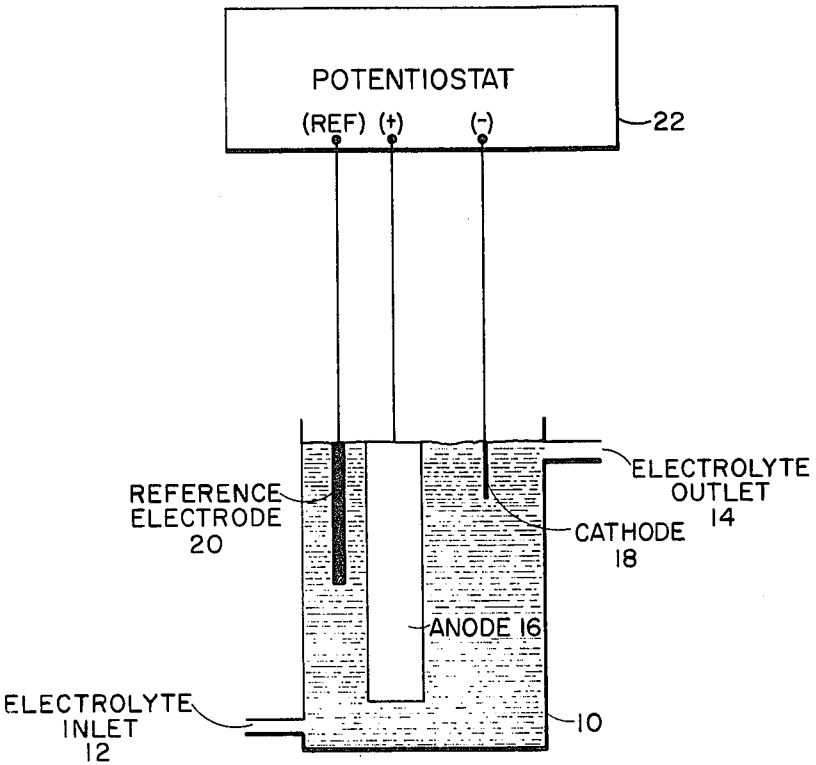
POTENTIOSTAT
22
(REF)
(+)
(-)
REFERENCE ELECTRODE 20
ANODE 16
CATHODE 18
ELECTROLYTE OUTLET 14
ELECTROLYTE INLET 12
10

PROCESS FOR OXIDIZING A METAL OF VARIABLE VALENCE BY CONTROLLED POTENTIAL ELECTROLYSIS

BACKGROUND OF THE INVENTION

1. Field of the Invention

This invention relates to a process for oxidizing a metal of variable valence by electrochemical means. More particularly, this invention relates to a process for oxidizing either or both vanadium and uranium contained in wet process phosphoric acid to a higher valence state for extraction by subsequent contact with complex organic extractants.

2. Description of the Prior Art

Various commercial processes require a metal of variable valence in an aqueous or organic solution to be in a particular valence state. For example, there are processes for the simultaneous coextraction of pentavalent vanadium and hexavalent uranium from aqueous acidic solutions containing the same, such as, for example, the process disclosed in U.S. Pat. No. 3,836,476. There also are numerous processes for the recovery of vanadium or uranium separately from wet process phosphoric acid.

Wet process phosphoric acid is produced by contacting phosphate rock with a mineral acid such as sulfuric acid. Most phosphate rock contains metal compounds in varying amounts. In many cases, these metal compounds are dissolved from the phosphate rock and appear in the wet process acid as contaminants. Vanadium and uranium compounds are among those dissolved from the phosphate rock, particularly when the rock is from the so-called western deposits of Idaho, Wyoming, Utah and Montana.

In the coextraction processes and many of the other processes, it is necessary to oxidize the vanadium and uranium in the wet process phosphoric acid to a higher valence state to enable the vanadium and uranium to be separated.

In the past, this oxidation has been achieved through the addition of chemical oxidants in an amount in excess of the stoichiometric requirement for oxidizing all the vanadium to pentavalent vanadium and all the uranium to hexavalent uranium. Normally, the oxidant is added in an amount of from about 50 percent to 1000 percent in excess of that which is stoichiometrically required. Various oxidizing agents have been used such as chlorates, manganese dioxide, permanganates, dichromates, peroxydisulfates, and ceric salts.

The disadvantages resulting from chemical oxidation are increased process expense, the possibility of increased plant corrosion, and further contamination of the acidic solution through addition of the oxidizing agent.

Though while not applied to the oxidation of vanadium and uranium, it is known that phosphoric acid containing trivalent iron impurities can be purified by direct current electrolytic reduction of the iron to the divalent oxidation state and precipitation of the iron impurities by the process disclosed in U.S. Pat. No. 2,288,752, or by direct current electrolytic reduction of the iron impurities and recovery of the phosphoric acid by extraction with a water-insoluble amine extractant, such as disclosed in U.S. Pat. No. 3,479,139.

The principal disadvantage of these reduction processes is that they operate by passing a constant direct current through the phosphoric acid electrolyte to purify the material. Thus, the prior processes do not provide a means of controlling the electrolysis, resulting in decreased current efficiency and thereby increased operating expenses.

It is desirable to provide a process whereby a metal of variable valence, such as, vanadium or uranium may be oxidized automatically by electrolytic means with improved current efficiency.

SUMMARY OF THE INVENTION

The discovery now has been made that metals of variable valence in solutions can be efficiently oxidized through electrolytic oxidation by potentiostatic techniques. The process of the present invention provides for the automatic control of the anode reference potential most suited to the oxidation reaction as referenced to a standard reference electrode half-cell so that the preferred, most efficient oxidation of the metal can be achieved.

The present invention includes a compact electrolytic cell which is capable of operating in a continuous manner at high current efficiency over extended periods of time. This cell has a relatively low operating cost due, in part, to the prolonged life of the electrodes, and the absence of diaphragms or other semi-permeable membranes which normally are required to separate the anode and cathode within a cell, which lowers material and maintenance costs.

Broadly, the electrolytic cell of this invention comprises a tank having an inlet and an outlet for an electrolyte solution. The tank contains at least one anode and at least one cathode. To eliminate the need for a diaphragm or semipermeable membrane within the electrolytic cell, the anode and cathode have a ratio of surface areas exposed to the electrolyte of from at least about 100:1. Preferably, the ratio of anode to cathode surface area exposed to the electrolyte is greater than 600:1. The preferred cathode surface area is the maximum area which is required to maintain the cathodic current density of the electrolytic cell sufficiently high such that substantially the only electrochemical reaction effected at the cathode is the preferential reduction of hydrogen while the metal of variable valence is oxidized at the anode of the electrolytic cell. The cell also is provided with a standard reference electrode half-cell capable of measuring the electrical potential between the anode and the reference electrode.

BRIEF DESCRIPTION OF THE DRAWING

The drawing is a diagrammatic schematic illustration of the electrolytic cell and process of this invention.

DESCRIPTION OF THE PREFERRED EMBODIMENT

Broadly, the present process is applicable to change the valence of a single metal or several metals in a solution such that they can be further processed.

The process of the invention can be used to oxidize trivalent and quadrivalent vanadium to pentavalent vanadium and quadrivalent uranium to hexavalent uranium in a wet process phosphoric acid. The process provides for the automatic control of the oxidation by maintaining the electrical potential measured between the anode and the reference electrode at the potential value most suited to the oxidation reaction.

Referring now to the drawing, the electrolytic cell employed in performing the process of the present invention is illustrated. The cell 10 is provided with an electrolyte inlet 12 and an electrolyte outlet 14. As specifically illustrated, the electrolyte inlet 12 and electrolyte outlet 14 are arranged to maintain a constant fluid level within the cell 10. The electrolyte may be introduced by, for example, pumping or gravity regulated flow. The specific location of the electrolyte inlet 12 and electrolyte outlet 14 in cell 10 may vary. The cell 10 also contains an anode 16, a cathode 18 and a standard reference electrode half-cell comprising a reference electrode 20. The electrodes can be made of conventional materials. The anode can be made of, for example, platinum, tantalum, niobium, graphite or the like, or a substrate material such as titanium and its alloys may be used which has been coated with a nobel metal such as platinum, iridium, ruthenium and the like. The cathode can be made of, for example, copper, nickel, mild steel, stainless steel, graphite, platinum or the like. The reference electrode may be, for example, a standard calomel electrode, a silver/silver chloride electrode, a mercury/mercury sulfate electrode or the like.

Normally, in an electrochemical process wherein a change in valence of a metal of variable valence is to be effected, such as in U.S. Pat. No. 3,361,651; U.S. Pat. No. 3,616,276; or U.S. Pat. No. 3,770,612, the disclosures of which are incorporated herein by reference, the anode is separated from the cathode in the electrolytic cell by a diaphragm or semi-permeable membrane. The diaphragm is present to impede the migration of the oxidized or reduced specie in the electrolyte from the anode or cathode, respectively, to the opposing electrode at which the oxidized or reduced specie would be returned to its former valence state.

The surprising discovery now has been made that if the ratio of the surface area of the anode to the surface area of the cathode exposed to the electrolyte is controlled to provide a ratio of from at least about 100:1, that no diaphragm or other semi-permeable membrane is required in the electrolytic cell of this invention. Preferably, the ratio of anode to cathode surface areas exposed to the electrolyte is greater than 600:1. The preferred cathode surface area is the maximum area which is required to maintain the cathodic current density of the electrolytic cell sufficiently high such that substantially the only electrochemical reaction effected at the cathode is the preferential reduction of hydrogen while the metal of variable valence is oxidized at the anode of the electrolytic cell.

The oxidation of the metal of variable valence in the cell 10 is effected through maintaining a preselected control potential between the anode 16 and the reference electrode 20. The reference electrode of the standard reference electrode half-cell senses the electrochemical potential of the anode and through a control circuit, such as, for example, a potentiostat 22, causes the electrical current and voltage applied to the electrolytic cell to vary as required to maintain the preselected potential value. A preferred form of a control circuit for commercial use is disclosed in U.S. patent application Ser. No. 885,397 filed Mar. 10, 1978, the disclosure of which is incorporated herein by reference. The preselected control potential is a function of the particular reference electrode half-cell employed in the process. The control potential value may be adjusted to compensate for the differences between various reference electrodes. The magnitude of the adjustment is in the order of the difference between the particular electrode's reference potentials.

When the electrolyte in cell 10 comprises WPA containing either or both uranium and vanadium, and the reference electrode 20 is a silver/silver chloride electrode, the control potential employed is in the range of from about +800 millivolts to about +1800 millivolts versus the reference electrode to oxidize the uranium to the hexavalent state and the vanadium to the pentavalent state. Preferably, the control potential is maintained in the range of from about +1200 millivolts to about +1500 millivolts.

The treatment time required to oxidize the metal of variable valence in the electrolyte is a function of the concentration of the metal present in the electrolyte.

To further illustrate the process of this invention, and not by way of limitation, the following examples are provided.

EXAMPLE I

This example is to illustrate the effect that the ratio of the surface area of the anode to the surface area of the cathode has upon the operability of the process.

First, a test is performed in which an electrolytic cell 10 is provided with a platinized titanium anode 16 and a stainless steel cathode 18. The anode 16 has a surface area of 8 square inches. The ratio of the surface area of the anode to the surface area of the cathode is 10:1. The electrolyte comprises 250 milliliters of WPA containing 24 milliequivalents of vanadium per liter of solution as $V_2O_5$. The temperature of the electrolyte in the cell is 50° C. The reference electrode is a silver/silver chloride electrode. The control potential selected is +1325 millivolts versus the reference electrode.

The cell is operated potentiostatically for 3 hours. Initially, vanadium oxidation occurs at the anode and hydrogen gas is evolved at the cathode. After 2 hours, no hydrogen evolution is visible at the cathode and oxidation of the vanadium reached an equilibrium condition in which pentavalent vanadium is reduced at the cathode as further vanadium is oxidized at the anode.

A second test is performed in which the cathode 18 in the electrolytic cell 10 is replaced with a stainless steel cathode having a surface area of 0.012 square inches. The ratio of surface areas now is 667:1. The electrolyte is replaced with fresh WPA containing 24 milliequivalents of vanadium per liter of solution as $V_2O_5$. The cell is operated as before for 5 hours. The vanadium in the electrolyte is completely oxidized and no equilibrium condition is found to occur.

The test results clearly demonstrate that the ratio of the surface area of the anode to the surface area of the cathode in the electrolytic cell has an effect upon the oxidation of a metal in an electrolytic cell which contains no diaphragm or other semi-permeable membrane to separate the cell into separate anode and cathode compartments.

EXAMPLE II

An electrolytic cell 10 is provided with a platinized titanium anode 16 having a surface area of 8 square inches and a stainless steel cathode 18. The ratio of the surface area of the anode to the surface area of the cathode is 600:1. The electrolyte comprises WPA containing trivalent vanadium and quadrivalent uranium. The reference electrode 20 is a silver/silver chloride electrode. The control potential selected is +1350 millivolts. The cell is operated potentiostatically for 1 hour to electrolyze the electrolyte. A sample of the fresh electrolyte and the electrolyzed electrolyte then is analyzed and the electrolyzed electrolyte now is found to contain pentavalent vanadium and hexavalent uranium and a lesser quantity of trivalent vanadium and quadrivalent uranium than originally present in the electrolyte. Thus, these results demonstrate the ability of the present invention to oxidize vanadium and uranium.

While the present invention has been described with regard to that which is considered to be the preferred embodiment thereof, it is to be understood that changes can be made in the process without departing from the spirit or scope of the invention as set forth in the following claims.

What is claimed is:

1. A process for changing the valence of a metal of variable valence state in a solution to a higher valence state which comprises:

providing an electrolytic cell containing an electrolyte comprising the solution containing the metal of variable valence and having an anode and a cathode positioned therein, said anode and cathode having an anode surface area to cathode surface area ratio of at least about 100:1 exposed to said electrolyte in said cell, said cell having no separate anode and cathode compartments within said cell;

providing a reference electrode in ionic contact with said electrolyte in said electrolytic cell; and electrolyzing said electrolyte within said electrolytic cell by potentiostatic means wherein the electrochemical potential measured between the anode and the reference electrode is maintained in a preselected potential range to change the valence of the metal of variable valence state to a higher valence state.

2. The process of claim 1 wherein the electrolyte is wet process phosphoric acid containing at least one member selected from the group of uranium and vanadium.

3. The process of claim 2 wherein the reference electrode is selected from the group consisting of a silver/silver chloride electrode, a standard calomel electrode and a mercury/mercury sulfate electrode.

4. The process of claim 2 wherein the preselected potential range is defined further as a potential value in the range of from about +800 to +1800 millivolts versus the reference electrode.

5. The process of claim 2 wherein the preselected potential range is defined further as a potential value in the range of from about +1200 to +1500 millivolts versus the reference electrode.

6. The process of claim 5 wherein the ratio of anode to cathode surface area is defined further as being greater than about 600:1.

7. The process of claim 1 wherein the ratio of anode to cathode surface area is defined further as being greater than about 600:1.

8. The process of claim 1 in which the surface area of the cathode is maintained at the maximum area which maintains the cathodic current density of the electrolytic cell sufficiently high such that substantially the only electrochemical reaction to occur at the cathode in the electrolytic cell is the preferential reduction of hydrogen while the valence of the metal of variable valence state contained in the electrolyte within the electrolytic cell is changed to a higher valence state.

* * * * *